United States Patent [19]

Hanyu et al.

[11] Patent Number: 4,862,816

[45] Date of Patent: Sep. 5, 1989

[54] COMPUTER OPERATED SEWING MACHINE WITH A MODE SWITCHING FUNCTION

[75] Inventors: Susumu Hanyu; Akio Koide, both of Tokyo, Japan

[73] Assignee: Janome Sewing Machine Co., Ltd., Tokyo, Japan

[21] Appl. No.: 173,156

[22] Filed: Mar. 24, 1988

[30] Foreign Application Priority Data

Apr. 3, 1977 [JP] Japan ..... 52-49825

[51] Int. Cl.[4] ..... D05B 3/02

[52] U.S. Cl. ..... 112/456; 112/458; 112/235; 112/140

[58] Field of Search ..... 112/456, 458, 453, 454, 112/457, 176, 177, 140, 151, 235, 121.11, 121.12

[56] References Cited

U.S. PATENT DOCUMENTS

| | | | |
|---|---|---|---|
| 3,795,209 | 3/1974 | Smith | 112/140 |
| 4,289,084 | 9/1981 | Takenoya et al. | 112/235 X |
| 4,409,915 | 10/1983 | Eguchi et al. | 112/453 X |
| 4,599,962 | 7/1986 | Kongoh et al. | 112/454 |
| 4,651,663 | 3/1987 | Murakami et al. | 112/456 X |

*Primary Examiner*—Peter Nerbun

*Attorney, Agent, or Firm*—Michael J. Striker

[57] ABSTRACT

In a sewing machine provided with a needle position adjusting device to position a needle relative to a basic line, a switching arrangement is provided to switch the needle position adjusting means from a needle amplitude adjusting mode to a mode of adjusting the needle basic line, whereby one adjusting device may be used as a needle amplitude adjusting device for ordinary stitching patterns and as a needle basic line-adjusting device for specific stitching patterns.

3 Claims, 7 Drawing Sheets

5 Key board for selecting patterns
35 Key for adjusting needle position
38 Key for manually adjusting feed amount
36 Switching
32 Memory of pattern generating information
34 Discrimination of specific pattern
37 Manual adjustment of needle amplitude amount
41 Manual adjustment of needle basic line
39 Manual adjustment of feed amount
33 Memory of selected pattern generating information
14 Motor of adjusting needle position
25 Motor of adjusting feed
40 Memory of adjusted pattern generating information ① Adjust needle position ② Adjust feed amount

FIG_5

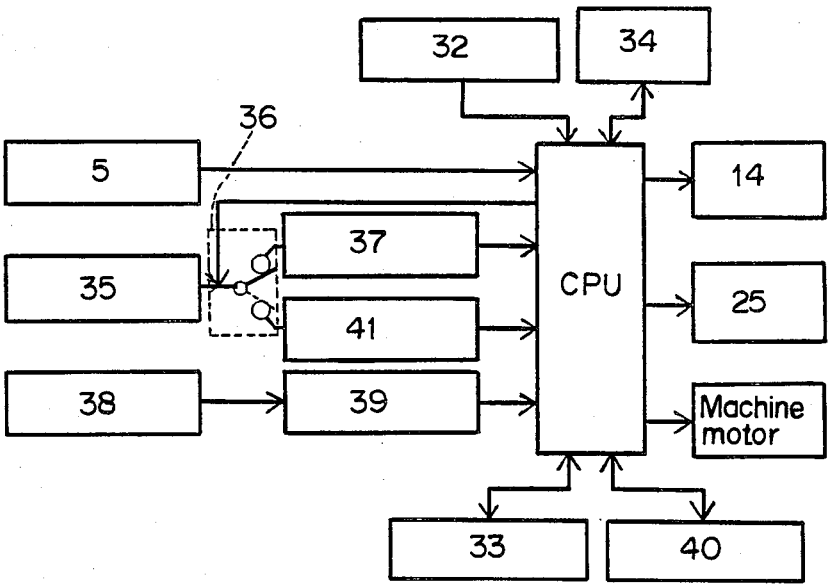

5 Key board for selecting patterns

35 Key for adjusting needle position

38 Key for manually adjusting feed amount

36 Switching

32 Memory of pattern generating information

34 Discrimination of specific pattern

37 Manual adjustment of needle amplitude amount

41 Manual adjustment of needle basic line

39 Manual adjustment of feed amount

33 Memory of selected pattern generating information

14 Motor of adjusting needle position

25 Motor of adjusting feed

40 Memory of adjusted pattern generating information

FIG_7
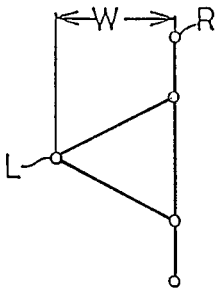
PRIOR ART
FIG_9(a)
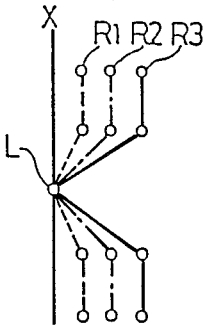
PRIOR ART
FIG_9(b)
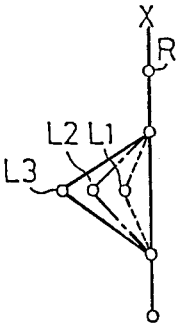
PRIOR ART
FIG_9(c)
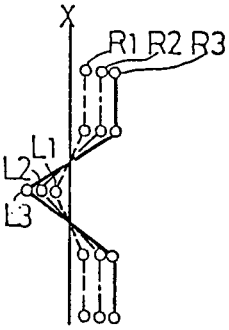
PRIOR ART
FIG_11
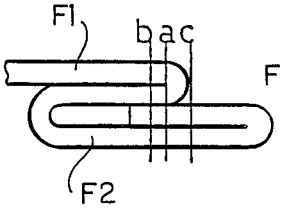
FIG_8
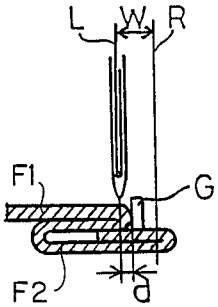
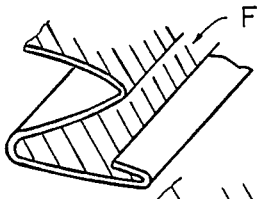
FIG_10(a)
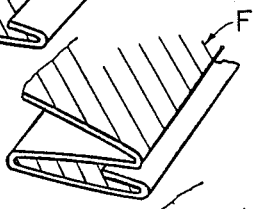
FIG_10(b)
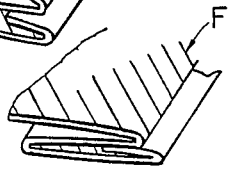
FIG_10(c)

COMPUTER OPERATED SEWING MACHINE WITH A MODE SWITCHING FUNCTION

FIELD OF THE INVENTION

The present invention relates to a computer operated sewing machine, and more particularly to a sewing machine provided with a mode switching function for a needle position adjusting device to switch the same in response to a selected pattern to be stitched.

BACKGROUND OF THE INVENTION

In many stitchings to be carried out by guiding a fabric to a needle, a blindstitching is typical, and the invention will be explained with reference to this stitching.

As shown in FIG. 7 and as generally known, a blindstitched pattern has a predetermined width W between a left needle dropping position L and a right needle dropping position R. Further it is generally known that the left needle dropping position L is a reference along which is guided an end part of the upper fold of fabric to be sewn as shown in FIG. 8.

It is however required that the left and right needle dropping positions L, R are changed in dependence upon the thickness of a fabric. So far it has been done as follows:

In FIGS. 9*a* to 9*c*, a basic line of needle position is shown by "X" which corresponds to one of the L, M and R needle positions as generally known. If the basic line X is set to the left needle dropping position L as shown in FIG. 9(*a*), the left needle dropping position L is fixed, and the right needle dropping position R is variable as shown at R1, R2, R3 relative to the left needle dropping position L.

If the basic line X is set to the right needle dropping position R as shown in FIG. 9(*b*), the right needle dropping position R is fixed, and the left needle dropping position L is variable as shown at L1, L2, L3 relative to the right needle dropping position R.

If the basic line X is set to the middle needle position M as shown in FIG. 9(*c*), the left and right needle dropping positions L, R are varied at the same ratio with respect to the middle position M.

The fabric F is folded in the manner as shown in FIGS. 10(*a*) to 10(*c*) to provide therein an upper fold F7, and a lower fold F2 to be blind-stitched thereat, and the edge of the upper fold F1 is set laterally to a guide G of a blind stitching presser foot 47 as shown in Figs.8, 13, 16 and 17, in which the presser foot 47 is pressed against the upper and lower folds F1, F2 of the fabric F and the guide G is pressed against the lower fold F2. The guide G may be fixed to the presser foot 7 as shown in FIG. 13 or may be adjustable laterally of the presser foot 47 as shown in Figs.16 and 17.

Then it is required that the left needle dropping position L is set to an appropriate position on the fabric F where a needle penetrates the upper and lower folds F1, F2 of the fabric F as shown in FIG. 8. More precisely the appropriate position is represented by (*a*) in FIG. 11, the position being slightly spaced inward from the edge of the upper fold F, so that the formed stitches S may not be conspicuous as shown in FIG. 12(*a*) when the uppermost part of the fabric F is unfolded. The stitches S in FIG. 12(*a*) are shown in contrast to the conspicuous stitches S1 (FIG. 12*b*) which are undesirous and may be formed when the left needle dropping position L is set to the position (*b*) on the fabric F in FIG. 11 where the needle is spaced far away inward from the edge of the upper fold F1, as compared with the needle position (*a*). Moreover such conspicuous stitches S1 will cause shrinkage of the fabric when the latter is unfolded. On the other hand, if the left needle dropping position L is set to a position (*c*) in FIG. 11 where the needle is spaced outward from the edge of the upper fold F1, the blindstitches are not formed on the upper fold F1 and result in failure of the blindstitching function as shown in FIG. 12(*c*).

With respect to the formation of blindstitches, there have been generally three types of operation as follows.

(1) A blindstitching presser foot having a guide fixed thereto is employed in combination with a sewing machine storing a blindstitch pattern of a predetermined amplitude.

(2) A blindstitching presser foot having a guide fixed thereto is employed in combination with a sewing machine storing a blindstitch pattern, the amplitude and basic line of which may be varied.

(3) A blindstitching presser foot having a guide provided as being adjustable laterally thereof is employed in combination with a sewing machine storing a bilndstitch pattern, at least the amplitude of which may be varied.

In case of item (1), the blindstitching presser 47 having the guide G fixed thereto as shown in FIG. 13 is employed in combination with the sewing machine as mentioned in the item (1). In this case, the needle positions are constant at both sides of the guide G. However because of the possible divergences in precision of parts in each of the sewing machine, generally the guide G is mounted on the presser foot 47 such that the needle may drop at the left position L where the needle is sufficiently spaced inward from the edge of the upper fold F1 to secure the correct formation of blindstitches. More precisely, the dimension (*d*) in FIG. 8 is amplified more than normally required, and this often causes the conspicuous (large) stitches S1 which are undesired.

In case of item (2), the blindstitches may be produced in the manner as shown in FIGS. 9(*a*), 9(*b*) or 9(*c*), in which the amplitude may be varied with respect to the basic line as shown at L, R or M as described herein above. In case of FIG. 9(*a*), the right needle dropping position R may be variably set from the fixed left needle dropping position L. However as the distance (*d*) in FIG. 8 is predetermined by the guide G with an amplitude dimension, for the reason as mentioned above, this may cause conspicuous stitches S1. In case of FIG. 9(*b*), the left needle droping position L may be variably set from the fixed right needle dropping position R. However as distance (*d*) in FIG. 8 is predetermined by the guide G with an amplitude dimension, this may cause the lower fold F2 to loose by of a considerable size of dimension E to the left loose as shown in FIGS. 14 and 15. In case of FIG. 9(*c*), if one of the left and right needle dropping positions L, R, the other the needle dropping positions is varied, and therefore the defects as mentioned in item 1 and in case of FIG. 9(*b*) may be caused.

In case of item (3), the guide G may be adjusted laterally of the presser foot 47 as shown in FIGS. 16 and 17 to variably determine the distance (*d*) of the blindstitch in FIG. 8. However the mechanical play of the presser foot structure will fail to stabilize the guide G in the set position relative to the presser foot 47 resulting in divergences of the blindstitches formed on the fabric.

The above mentioned conventional mode of stitching is insufficient with respect to required conditions of the formation of blindstitches, due to the defects as described above since it has been desired that, (1) the fabric guiding parts are stable;

(2) the darning amplitude is made as small as possible; and (3) the needle dropping position may be adjusted with respect to the fabric guiding.

SUMMARY OF THE INVENTION

It is an object of the present invention to provide an improved computer operated sewing machine.

In a sewing machine which stores stitch control signals in an electronic memory of a microcomputer, the present device is provided with a fixed fabric guide and an instrument which switches as a needle position adjusting means from an adjusting mode of adjusting a needle amplitude to an adjusting mode of adjusting a basic line of a needle with respect to the selection of a specific stitching pattern to be used in association with a fabric presser foot which guides the fabric to a needle.

By selection of the blindstitching, it is also possible to set the needle in a predetermined amplitude suitable to the blindstitching. For practicing the blindstitching, the fabric is guided to a fabric guide part of the presser foot, and the position of the needle basic line is adjusted by means of the needle position adjusting device which has been switched to the adjusting mode of the needle basic line.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 5 is a block diagram of control parts of the sewing machine;

FIG. 7 is a diagrammatic view of a standard blindstitch pattern;

FIG. 8 is a view showing a relative position of the needle, guide and fabric for forming stitches of the blindstitch pattern;

FIGS. 9(*a*), 9(*b*) and 9(*c*) are diagrammatic views of the adjustable needle dropping positions for the blindstitch patterns;

FIGS. 10(*a*), 10(*b*) and 10(*c*) are views of a fabric folded for the blindstitches;

FIG. 11 is a view showing the needle dropping positions on one side of the blindstitching width;

DETAILED DESCRIPTION OF PREFERRED EMBODIMENT

The present invention will be explained in detail with reference to the attached drawings.

Figure 1:
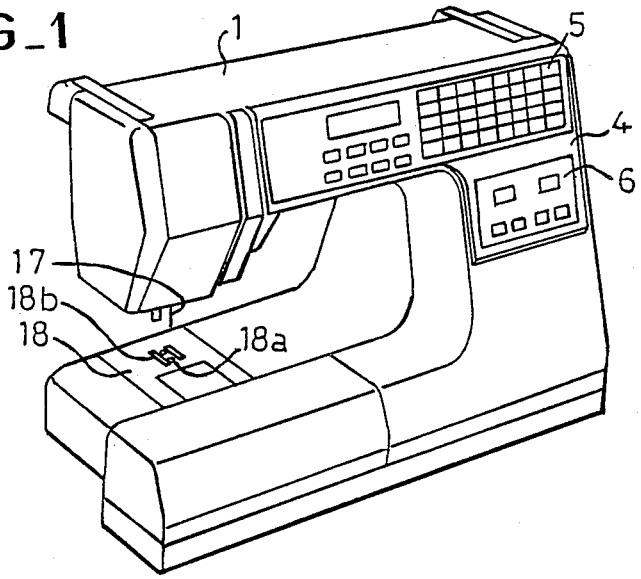
FIG. 1 is a schematic perspective view of a sewing machine incorporating the invention.
Figure 4:
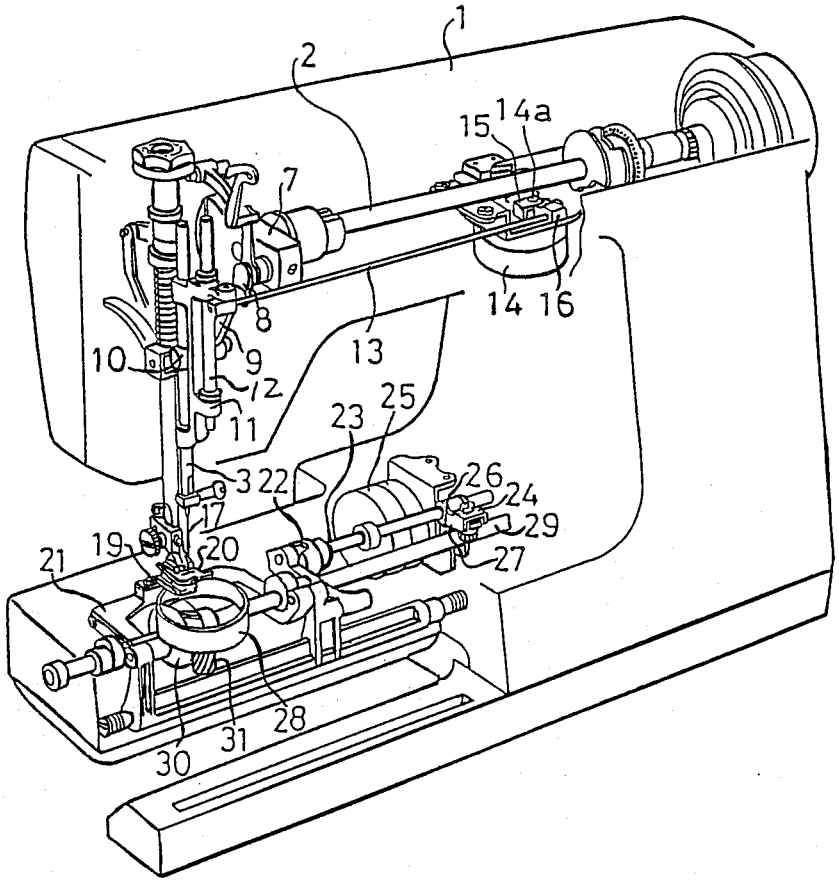
FIG. 4 is a perspective view of an interior mechanism of the sewing machines.

FIG. 1 shows a perspective view of a sewing machine incorporating a mode-switching instrument for producing blindstitches according to the invention. Referring to FIG. 4 it will be seen that a machine frame 1 of the sewing machine is provided with the needle bar 3 possitioned movably vertically and connected to a drive shaft 2 which is in turn connected to a drive part (not shown) and subjected to rotation. The needle bar 3 is fixed in a needle bar holder 10 which is inserted at its upper and lower parts in a needle bar supporter 11. A drive shart 2 is rotatably supported in the machine frame 1, and a crank 7 is provided at the end of the drive shaft 2. A crank rod 9 is rotatably connected to an end of a needle bar crank 8 which is secured to the end of the crank 7. The needle bar supporter 11 is mounted on a shaft 12 secured to the machine frame 1, and is restricted in vertical movements but is only rotatable. The needle bar supporter 11 is connected at its end to one end of a rod 13 which is connected, via a link 16, at its other end to an arm 15 secured on an output shaft 14*a* of a needle amplitude stepping motor 14.

As shown in FIG. 1, the machine frame has, at its lower part, a needle plate 18 formed with a needle dropping hole 18*a* for passing a needle 17 secured to the needle bar 3 at its end portion.

Numeral 19 is a feed dog which rises from and falls into the feed dog groove 18*b* formed in the needle plate 18 (FIG. 1) and feeds a fabric in synchronism with a presser foot 20 (FIG. 1). The feed dog 19 is mounted to a horizontal feed arm 21 driven by the drive shaft 2. The movement of the horizontal feed arm 21 is adjusted by turning the same, and a turning angle adjusting member 22 is fixed on the end of an adjusting shaft 23 so that the transmission amount of rotation to the horizontal feed arm 21 is adjusted by rotating the member 22. An arm 24 secured on the end of the shaft 23 is connected to a crank 26 mounted on the output shaft of a feed adjustment stepping motor 25 secured to the machine frame 1.

Numeral 28 designates a loop taker device as a thread loop hooking means, rotatably supported in the machine frame 1 under the needle plate. A gear 30 is secured on a shaft 29 to be rotated in synchronism with the needle bar 3, while a gear 31 is secured under the loop taker device 28, and these gears 30 and 31 are meshed with one another to transmit the rotation to the loop taker device.

As is seen in FIG. 1, the machine frame 1 is attached with a scale panel 4 on which there are furnished a key board 5 of a pattern selecting device and a key board 6 for manually adjusting the needle position and feed amount.

Figure 6:
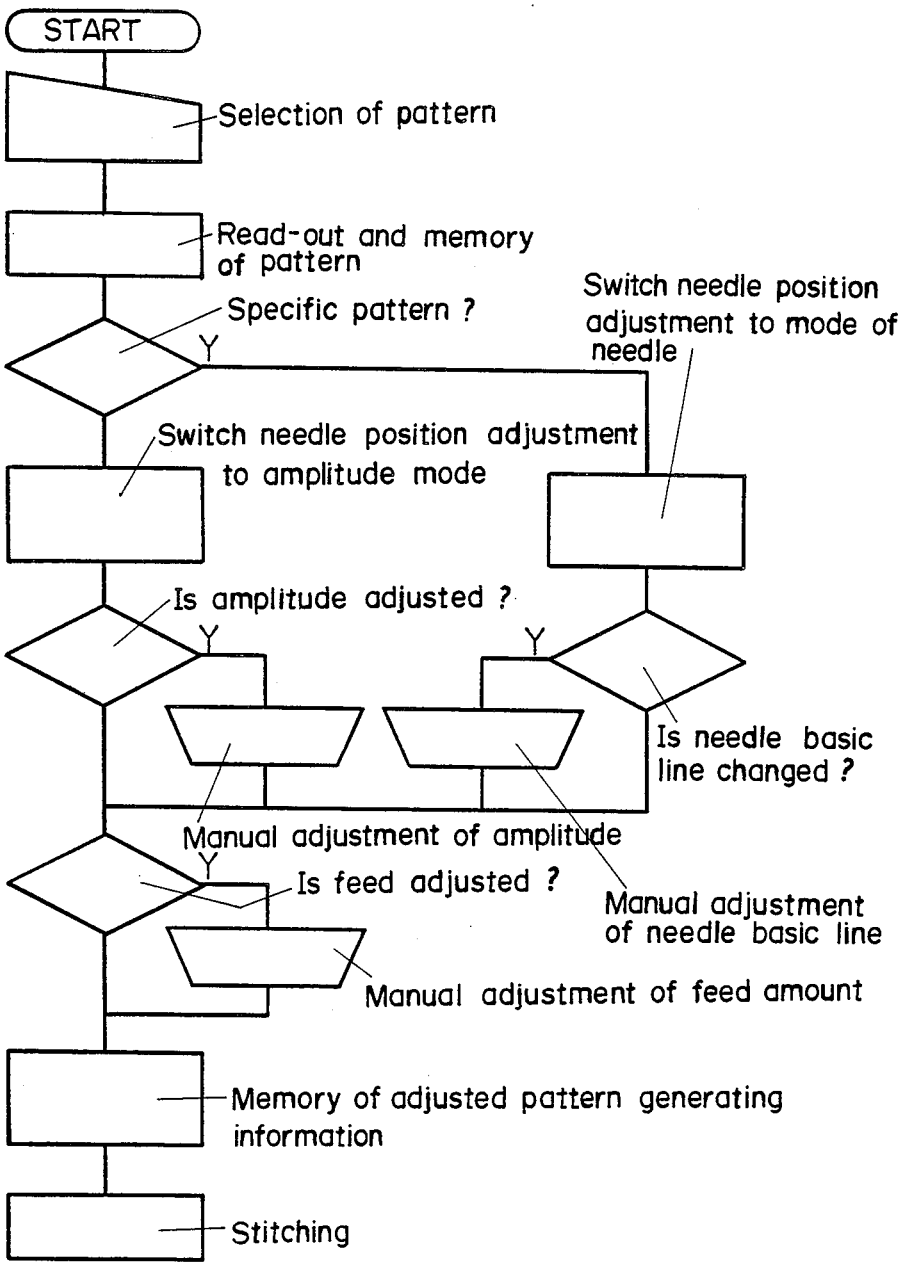
FIG. 6 is a flow chart for operating the sewing machine.

A central device for controlling the electronic sewing machine is seen in FIG. 5, and will be explained with operations will be explained with reference to FIG. 6.

A pattern to be stitched is selected by operating the pattern selecting key board 5 and is read out from a memory 32 of pattern generating information and stored in a memory 33 of the selected pattern generating information. The pattern stored in the memory 32 is set at predetermined values of the needle amplitude and feed amount.

Figure 18:
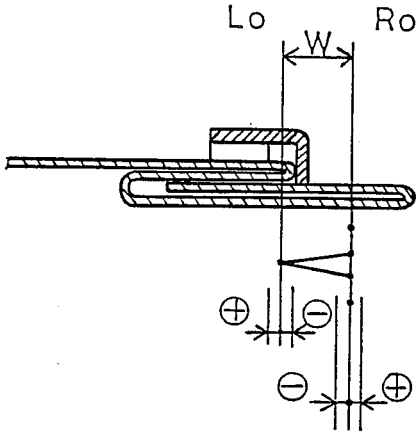
FIG. 18 shows adjustable needle dropping positions for blindstitches.
Figure 19:
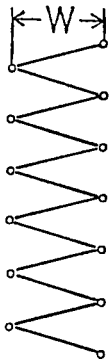
FIG. 19 shows an ordinary stitched pattern.

Patterns to be stitched include ordinary patterns as seen in FIG. 19 and specific stitches which require to control a fabric guiding position of the presser foot and a needle position as seen in FIG. 18. Specific patterns are accompanied with a signal showing that the pattern is specific.

Whether the selected pattern is specific or not is discriminated by a discriminating means 34 of specific patterns. If the pattern to be stitched is an ordinary one as seen in FIG. 19, an input from a key 35 of adjusting the needle position of the key board 6 is switched to a device 37 for manually adjusting the needle amplitude amount, that is, a device including the needle position adjusting key 35 is switched to an amplitude mode.

Figure 3:
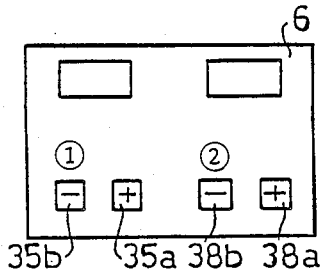
FIG. 3 is a schematic view of a manually operated key board for adjusting needle positions and fabric feed.

The amplitude amount is increased more than a predetermined amount by operating +key 35*a* of the needle position adjusting key 35, and is decreased by operating −key 35*b* (FIG. 3. With respect to the feed amount, a feed adjusting key 38 is operated, +key 38*a* and −key 38*b* for generating the adjusted patterns are operated, a predetermined feed is adjusted by means 39 and is stored in a memory 40 as shown in FIG. 5.

FIG. 5 further illustrates a needle position adjusting motor 14 and a feed adjusting motor 25 which are driven by a stitching order in response to a timing signal generated by rotation of the sewing machine, following the patern generating information stored in the memory 40, and the needle position and the feed are controlled to form stitching patterns.

Figure 20:
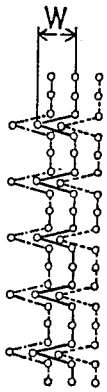
FIG. 20 shows adjusting of the blindstitches.

If the selected pattern is a specific one as seen in FIG. 20, an input from the needle position adjusting key 35 by a discriminating signal from the specific pattern-discriminating means 34 is switched to the needle basic line-manually adjusting means 41 as shown with a dotted line in FIG. 5 by means of a switching means 36. That is, the needle position adjusting device is switched to the needle basic line mode.

Figure 2:
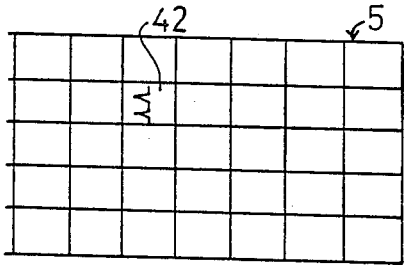
FIG. 2 is a shematic view of a key board for selecting patterns.
Figure 12A:
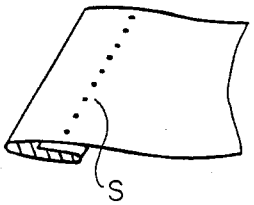
FIGS. 12(*a*), 12(*b*) and 12(*c*) are views of the exposed stitches on the upper surface of the fabric when the latter is unfolded.
Figure 12B:
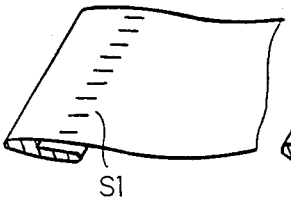
Figure 12C:
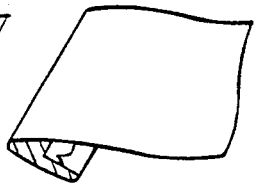

"Blindstitch" as the specific pattern as seen in FIG. 2 is memorized with a predetermined needle basic line position R and a fixed amplitude amount W.

The needle basic line position R shown in FIG. 20 is moved to the right by the +key 35*a* of the needle position adjusting key 35 as the fixed amplitude amount W is as shown with the dotted line, and is moved to the left by the −key 35*b* as the fixed amplitude amount W is as shown with a chain line.

The feed amounts in the ordinary stitching pattern are the same in a case of the ordinary stitching, and the +key 38*a* and the −key 38*b* of the feed adjusting key 38 are operated to adjust the predetermined feed amount by the feed amount-manually operating device 39 and this feed amount is stored in the adjusting pattern generating information memory 40. A needle position adjusting motor 14 and a feed adjusting motor 25 are driven by a stitching order in response to a timing signal generated by rotation of the sewing machine, following the pattern generating information stored in the memory 40, and the needle position and the feed are controlled.

Figure 13:
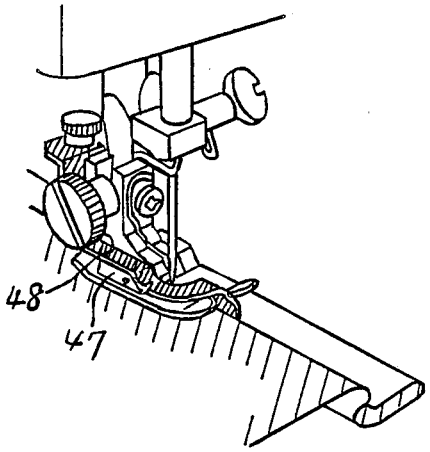
FIG. 13 is a perspective view of a presser foot having a guide fixed thereto and attached to the sewing machine.
Figure 14:
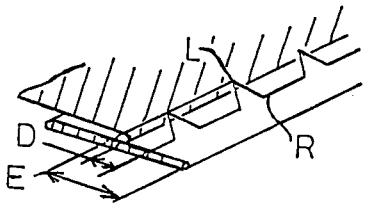
FIGS. 14 and 15 are views showing the blindstitches which may be formed by using the presser foot shown in FIG. 13.
Figure 15:
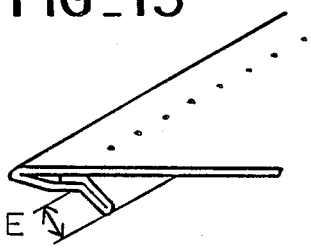
Figure 16:
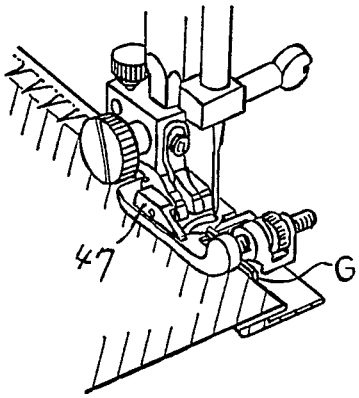
FIG. 16 is a perspective view of a presser foot having a guide which is adjustable laterally thereto and attached to the sewing machine.
Figure 17:
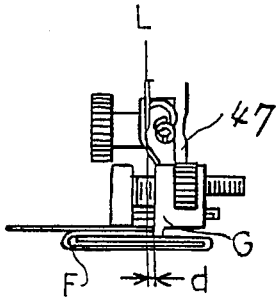
FIG. 17 is a front view of the presser foot of FIG. 16.

For forming the blindstitch as shown in FIG. 18, a blindstitching presser foot 47 is employed as shown in FIG. 13 which has the fixed fabric guide, and the blindstitching pattern shown with at 42 in FIG. 2 is selected by the pattern selecting key board 5 to read out a pattern generating information from the memory 32 and store it in the memory 33. The needle dropping left position is adjusted in that the position R0 (FIG. 18) of the right basic line as the position of needle basic line is adjusted by operating the +key 35*a* or the −key 35*b* of the needle position adjusting key 35.

It wil be understood that each of the elements described above, or two or more together, may also find a useful application in other types of sewing machines differing from the types described above.

While the invention has been illustrated and described as embodied in a a sewing machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A computer operated sewing machine comprising: stitch forming instrumentalities including a vertically reciprocating and laterally swingable needle, memory means storing stitch data for a plurality of different patterns to be stitched including a blind stitch pattern which is stitched with a specific presser foot having a guide for guiding a fabric with respect to the needle while the needle is controlled to laterally move with a fixed amplitude in a constant cycle from a fixed basic needle position located on one side of the fabric guide of said presser foot; pattern selecting means selectively operated to selectively read out the stitch patterns from the memory means to control the needle position with respect to the fabric to be stitched; means for adjusting the swinging amplitude of the needle; means for adjusting the basic needle position; means for discriminating if a selected pattern is the blind stitch pattern or a pattern other than the blind stitch pattern, said discriminating means producing a first signal when the selected pattern is other than the blind stitch pattern and producing a second signal when the selected pattern is the blind stitch pattern; and switching means operated in response to the first signal of said discriminating means to make effective said needle swinging amplitude adjusting means, said switching means operated in response to the second signal to make effective said basic needle position adjusting means to adjust the basic needle position with respect to said presser foot fabric guide.

2. The sewing machine as defined in claim 1 further comprising means including at least two keys, one of which is operated to optionally increase the needle swinging amplitude and the other of which is operated to optionally decrease the needle swinging amplitude while said switching means is responsive to said first signal of said discriminating means.

3. The sewing machine as defined in claim 2, wherein said one of the keys is operated to optionally adjust the basic needle position in the direction departing from said fabric guide of said presser foot and the other of the keys is operated to optionally adjust the needle position in the direction toward the basic needle position.

* * * * *